United States Patent [19]

Proctor

[11] 3,979,993

[45] Sept. 14, 1976

[54] SUPPORT CUSHION FOR PLUCKED STRING INSTRUMENT

[76] Inventor: Alan Robert Proctor, 5039 No. 2 N. Capitol St., Washington, D.C. 20011

[22] Filed: Oct. 31, 1975

[21] Appl. No.: 627,783

[52] U.S. Cl. ..... 84/327; 84/453

[51] Int. Cl.[2] ..... G10G 5/00

[58] Field of Search ..... 84/280, 281, 327, 453, 84/465, 469

[56] References Cited

UNITED STATES PATENTS

| | | | |
|---|---|---|---|
| 1,261,841 | 4/1918 | Mortensen | 84/327 |
| 1,377,571 | 5/1921 | Fisher | 84/281 |
| 1,945,162 | 1/1934 | Rasmussen | 84/327 |

*Primary Examiner*—Lawrence R. Franklin
*Attorney, Agent, or Firm*—Pierce, Scheffler & Parker

[57] ABSTRACT

A cushion having an oblique upper surface adapted to be interposed between the underside of a plucked string instrument such as a guitar or lute and thigh of the performer to facilitate positioning of the instrument at the proper oblique position and height for classical playing. The cushion is partially filled with styrofoam globules so as to enable shaping of its contour to the curved underside of the sound box of the instrument as well as to the profile of the thigh of the performer. The oblique upper surface is made from a vinyl plastic material so as to prevent any slippage between it and the sound box, the bottom surface is made from a napped fabric to prevent slippage on the clothing of the performer and straps are provided to enable the cushion to be strapped around the thigh.

11 Claims, 4 Drawing Figures

FIG. 1
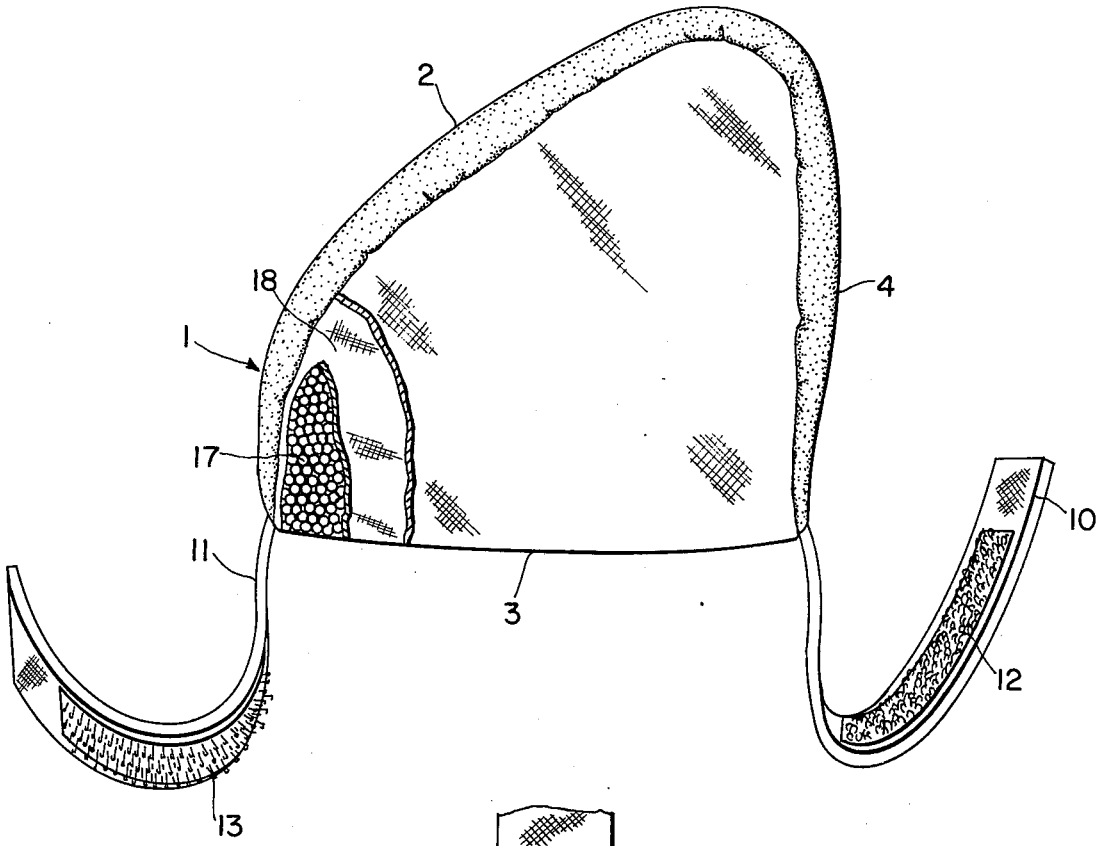
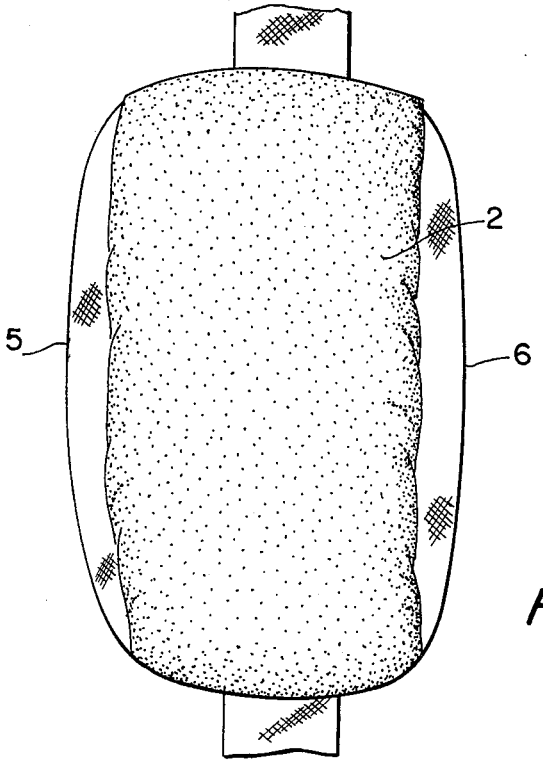
FIG. 2

SUPPORT CUSHION FOR PLUCKED STRING INSTRUMENT

BACKGROUND OF THE INVENTION

In playing a guitar or similar plucked stringed instrument such as lute, or mandolin in the so-called classic manner the performer is usually seated and the instrument is usually held at the proper oblique playing position by resting the underside of the sound box upon the left thigh. However, in order to support the instrument at the desired height it is necessary then to elevate the left leg and this has usually been accomplished by resting the left foot upon a low stool. A serious disadvantage incurred with use of the stool is that it places the body in a most awkward position which can often lead to back pains as well as to cramps or numbness in the left leg and buttocks which obviously interfere with the ability of the performer to play the instrument with total concentration which is essential to a good performance.

SUMMARY OF THE INVENTION

The principal objective of this invention is to provide as an advantageous alternative to the conventional foot stool a novel cushion structure which is interposed between the underside of the sound box and the thigh which enables the performer to sit in a more natural and comfortable position with both feet flat on the floor. Since the performer is now seated in a more natural position, the likelihood of back pains or leg cramps or numbness in the limb is essentially eliminated.

The ability to now keep both feet flat on the floor has the further advantage when the performer also sings as well as plays since it enables the performer to enjoy full use of the diaphragm in projecting the voice. This is not possible if the performer plays the instrument without a cushion between the instrument and thigh and thus is required to keep one foot elevated such as by resting it upon a foot stool.

The cushion can be made in different sizes as regards height, e.g. two sizes can be provided, one "small" for performers who would otherwise require a foot stool about 4 inches high, and the other "large" for use by performers who would otherwise require a considerably higher foot stool in order to properly position the instrument.

The cushion in accordance with the invention is characterized by an oblique upper surface and is partially filled with a particulate material, preferably a lightweight pelletized material, preferably small styrofoam globules, so as to enable the cushion to support the instrument at the desired height and oblique position for classical playing and also to conform the profile of its upper oblique surface to the profile of the curved underside of the sound box, and its undersurface to similarly conform to the profile of the upper surface of the thigh.

Preferably the cushion includes an inner bag made from muslin or a similar fabric containing the lightweight pelletized filling material and an outer casing. At least the oblique upper surface of the outer casing is made from a material which will provide a non-slip contact with the wood from which the sound box of the instrument is made, and it has been found that a vinyl plastic fabric is most effective. The underside of the outer casing is preferably made from a fabric having a napped surface such as wool or corduroy or felt in order to provide a non-slip contact with the clothed thigh of the performer. If desired, the sides of the outer casing can be made from a fabric which is essentially non-reflecting so as not to undesirably reflect stage or spot lighting. If an all-vinyl plastic material, or a vinyl plastic coated fabric is used for the entire outer casing, then at least a portion of the underside must be covered with a napped fabric. On the other hand, the oblique upper surface of the outer casing can be made from a vinyl plastic and the remainder made from a napped fabric. The outer casing has sufficient thickness to essentially muffle any sound made by movement of the individual pellets against one another within the inner bag.

The cushion is preferably made wide enough to support the instrument by partially embracing the curved underside of the sound box as it is placed in position between the sound box and thigh of the performer. Thus, for example, for a guitar having a curved sound box about 4½ inches wide, a suitable width for the cushion would be about 6 inches.

While the cushion in accordance with the invention could conceivably be secured to the underside of the instrument and serve its intended function, it is more advantageous to provide it with a strap arrangement by which the cushion can be strapped in place around the thigh. The thigh-girdling straps not only enable the cushion to be attached to the thigh but also permit the performer to adjust its position on the thigh by rotating the entire cushion in one direction or the other thereby to raise, or lower, the support level of the instrument above the thigh.

In lieu of a strap-on arrangement which is the most practical for performers wearing pants, an equivalent clamp-on arrangement using a pair of spring clamps which partially embrace the thigh could be used. This would be particularly suitable in the case where the performer is wearing a dress or skirt.

The foregoing as well as other objects and advantages related to the improved instrument-supporting cushion will become more apparent from the following detailed description of a preferred embodiment thereof and from the accompanying drawings.

BRIEF DESCRIPTION OF THE DRAWING

FIG. 1 is a view of the improved cushion in side elevation;

FIG. 2 is a top plan view;

DETAILED DESCRIPTION

Figure 3:
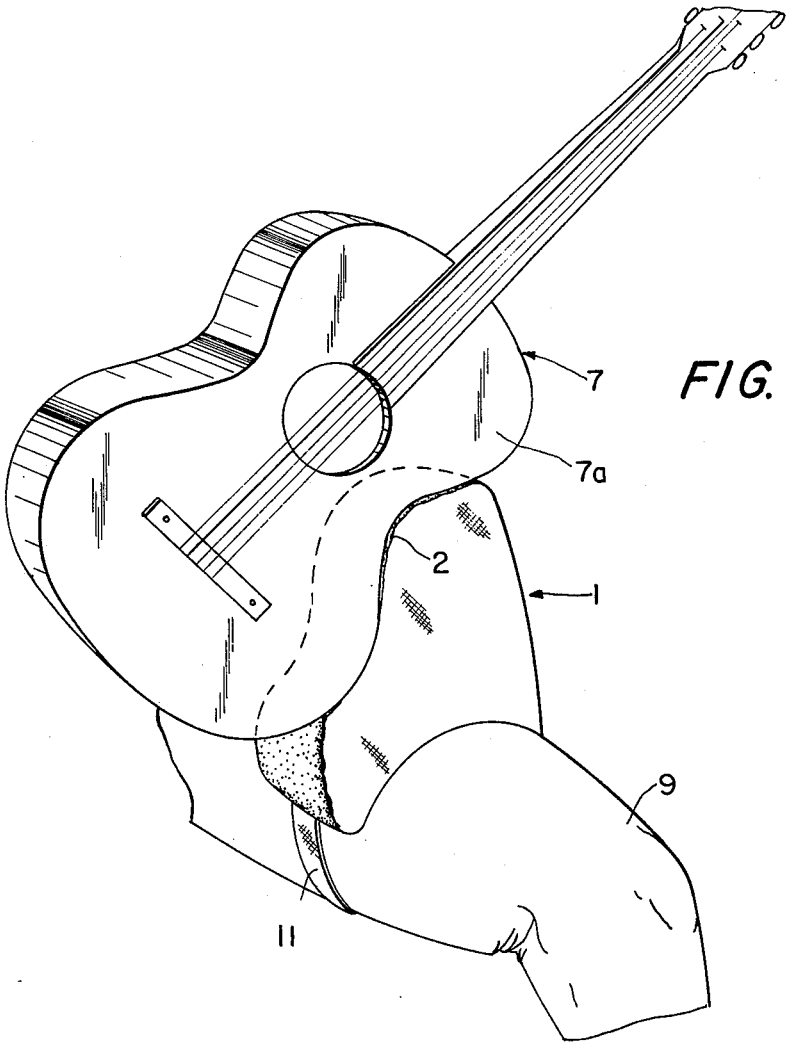
FIG. 3 is a view showing the cushion strapped to the thigh of the performer at the proper position for playing a guitar.
Figure 4:
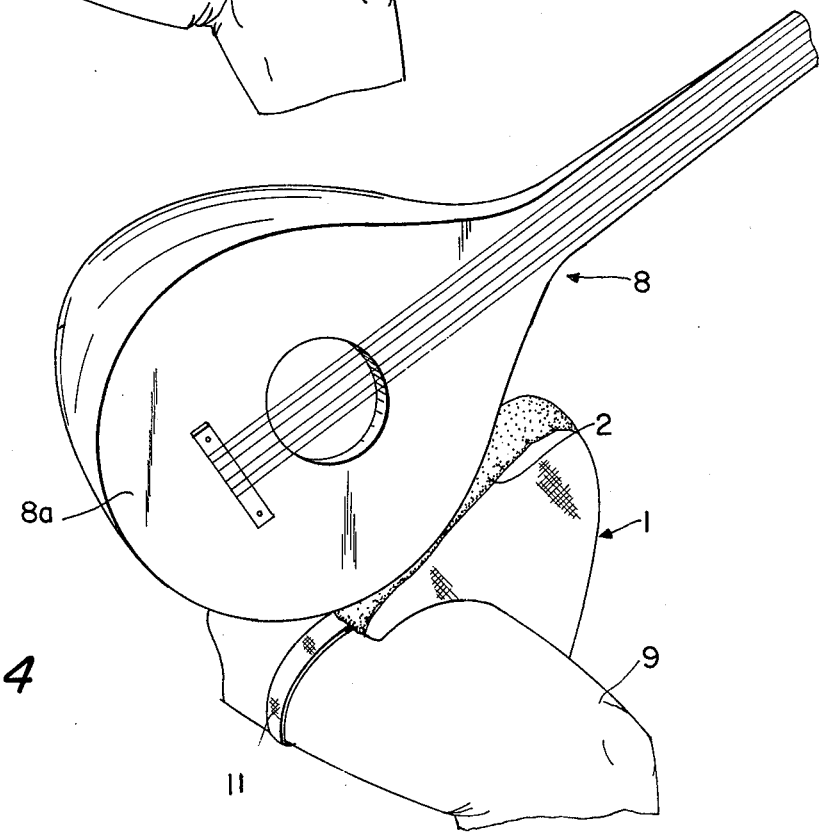
FIG. 4 is a view similar to FIG. 3 showing the position of the cushion when playing a lute.

With reference now to the drawings and to FIGS. 1 and 2 in particular, the general configuration of the instrument-supporting cushion 1 in accordance with the invention is characterized principally by an oblique upper surface 2, a bottom surface 3, a back surface 4 substantially at a right angle to the lower surface and side surfaces 5, 6. In the illustrated embodiment, the upper surface 2 is made from a material, preferably a vinyl plastic, which will provide an essentially non-slip contact with the wooden curved underside of the guitar 7, or lute 8 as depicted in FIGS. 3 and 4, respectively. For convenience in manufacture, the back surface 4 is also made of vinyl plastic. The remaining surface portions, i.e. the bottom and side surfaces, that is bottom and sides 3, 5 and 6 are conveniently made from one and the same material, namely a fabric having a napped surface such as wool or corduroy or felt. A dark fabric can be chosen such as to be essentially non-reflecting so as not to undesirably reflect stage or spot lighting. However, it is possible to use other fabric combinations so long as the oblique upper surface is a fabric which will establish a non-slip contact with the curved underside of the instrument's sound box *7a*(*8a*), and the bottom surface has a napped characteristic which serves to establish a clinging, non-slip contact with the clothed thigh of the performer to prevent similar slip.

In order to enable the cushion to be attached to the thigh 9, two thigh-girdling straps 10 and 11 are provided, one end of each strap being attached to the cushion at the ends of the bottom surface 3 and the other ends of the straps being provided with suitable fastening means. A "Velcro" type of strap fastener is illustrated, an elongated "loop" type pad 12 being attached to strap 10 and a similar complementary elongated "hook" type pad 13 being attached to strap 11. Being elongated, the self-engageable "Velcro" pads 12 and 13 provide for longitudinal adjustment of the strap connection to suit varying sized thighs.

The strap-on arrangement could conceivably be omitted in view of the clinging type napped fabric used for the bottom surface but provides the most positive protection against any slippage of the cushion during the performance and is also most helpful in the case where the cushion does not rest upon the top of the thigh as depicted in FIG. 3 which is the usual position adopted for playing a guitar 7 but rather is rotated slightly as depicted in FIG. 4 when the instrument is a lute 8 which has a differently configured sound box and rests at a lower position on the thigh than does a guitar.

As indicated at the outset, the cushion in accordance with the invention is partially filled with a particulate material, preferably a light-weight pelletized material, preferably small styrofoam globules 17. Pellet sizes of from 1/16 inch to ⅛ inch in diameter have been found to be practical. The cushion is only partially filled with the pelletized material in order to enable it to be "fluffed" and "shaped" to the particular contour of the underside of the sound box of the instrument and also to shape itself to the contour of the thigh, as depicted in FIGS. 3 and 4 as well as to bulge slightly upward and establish a slight overlap along the front and back faces of the sound box in order to better retain the instrument against any slipping movement during the performance. It has been found that the desired results are obtained when the cushion is filled with the pelletized material to about ¾ of its volumetric capacity.

Preferably the pelletized material 17 is contained within an inner bag 18 made of muslin or a similar fabric of the same configuration and volumetric capacity as an outer casing formed by the fabric surface portions 2, 3, 4, 5 and 6 which have been described. Besides being more practical, the inner muslin bag 18 aids in muffling out any sound made by movement of the pellets against one another.

I claim:

1. A cushion to be interposed between the curved underside of a plucked string instrument such as a guitar or lute and the thigh of the performer, said cushion having an oblique upper surface and being partially filled with a particulate material thereby to enable the instrument to be supported in the proper oblique position for classical playing, the partial filling of the particulate material enabling the oblique upper surface of the cushion to conform itself to that of the curved underside of the instrument and its bottom surface to similarly conform to the profile of the performer's thigh.

2. A cushion as defined in claim 1 for supporting a plucked string instrument wherein at least the oblique upper surface thereof is constituted by a fabric which forms essentially a non-slip engagement with the underside of the sound box of the instrument.

3. A cushion as defined in claim 2 wherein the fabric forming the oblique surface thereof is a vinyl plastic.

4. A cushion as defined in claim 1 for supporting a plucked string instrument wherein the bottom surface thereof is constituted by a fabric having a napped surface which enables the cushion to cling to the clothed thigh of the performer.

5. A cushion as defined in claim 1 for supporting a plucked string instrument wherein the oblique upper surface thereof is constituted by a vinyl plastic fabric forming a non-slip engagement with the underside of the sound box of the instrument and the bottom surface of the cushion includes a napped fabric forming essentially a non-slip engagement with the clothed thigh of the performer.

6. A cushion as defined in claim 1 for supporting a plucked string instrument wherein the particulate material partially filling the same is pelletized.

7. A cushion as defined in claim 6 for supporting a plucked string instrument wherein the pelletized material partially filling the same is constituted by styrofoam globules.

8. A cushion as defined in claim 7 for supporting a plucked string instrument wherein the styrofoam globules partially filling the cushion are between 1/16 inch and ⅛ inch in diameter.

9. A cushion as defined in claim 1 for supporting a plucked string instrument wherein the particulate material is enclosed within an inner bag.

10. A cushion as defined in claim 1 for supporting a plucked string instrument and which further includes means for strapping the cushion around the thigh of the performer.

11. A cushion as defined in claim 10 for supporting a plucked string instrument wherein said strap means are constituted by a pair of thigh girdling straps secured at one end to the cushion, the opposite free end portions of said straps being provided respectively with longitudinally extending strips of complementary self-clinging material thereby providing a longitudinally adjustable easily disengageable connection between the straps.

* * * * *